US009551486B2

(12) United States Patent
Jackow

(10) Patent No.: US 9,551,486 B2
(45) Date of Patent: Jan. 24, 2017

(54) AUTOMATED TORCH

(76) Inventor: Kaz Jackow, Kailua Kona, HI (US)

( * ) Notice: Subject to any disclaimer, the term of this patent is extended or adjusted under 35 U.S.C. 154(b) by 1004 days.

(21) Appl. No.: 13/083,036

(22) Filed: Apr. 8, 2011

(65) Prior Publication Data

US 2012/0258412 A1 Oct. 11, 2012

(51) Int. Cl.
*F23Q 1/04* (2006.01)
*F23D 11/42* (2006.01)

(52) U.S. Cl.
CPC ..... *F23D 11/42* (2013.01)

(58) Field of Classification Search
USPC ..... 431/132, 254, 239, 345
See application file for complete search history.

(56) References Cited

U.S. PATENT DOCUMENTS

| | | | | |
|---|---|---|---|---|
| 1,974,975 | A * | 9/1934 | Stein et al. | 251/309 |
| 3,364,704 | A * | 1/1968 | Bernstein | 431/28 |
| 4,173,498 | A * | 11/1979 | Gaines | 136/217 |
| 4,238,184 | A * | 12/1980 | Schilling | 431/59 |
| 5,205,730 | A | 4/1993 | Capdeville | |
| 5,980,238 | A * | 11/1999 | Collins, Sr. | 431/18 |
| 6,283,145 | B1 * | 9/2001 | Fenn | 137/489 |
| 6,653,790 | B2 * | 11/2003 | Willamor et al. | 315/91 |
| 6,733,282 | B2 | 5/2004 | Long | |
| 2005/0158682 | A1 * | 7/2005 | Morris | 431/354 |
| 2007/0160944 | A1 * | 7/2007 | Knight et al. | 431/264 |

FOREIGN PATENT DOCUMENTS

| | | | |
|---|---|---|---|
| DE | 3607558 | A1 * | 9/1987 |

* cited by examiner

*Primary Examiner* — Jason Lau
(74) *Attorney, Agent, or Firm* — Mastrogiacomo PLLC

(57) ABSTRACT

An automated torch for generating and sustaining a flame is provided that includes a head, the head including a burning chamber, the burning chamber being open to the atmosphere and weather elements to expose the flame to the atmosphere and weather elements, a pole, a valve, a programmable computer module, the module configured to convert a low voltage to a high voltage, the module further configured to actuate a valve, the module still further configured to control the rotation of the valve to vary the amount of fuel introduced into the burning chamber to modify the aesthetics of the flame, a sleeve nut, the sleeve nut configured to be adjustable to control the amount of air introduced in the burning chamber to modify the aesthetics of the flame, at least one fuel supply tube, a diffuser assembly and an igniter. The igniter positioned within the burning chamber and the igniter including an anode and a cathode. The anode and the cathode are positioned such that the anode is proximate the cathode to create a sufficient gap such that when the high voltage is applied to said igniter a spark is induced across the gap. The anode and the cathode of the igniter are configured to detect the presence of a flame within the burning chamber. The igniter is configured to be electrically connected to the programmable computer module, the programmable computer module programmed to interpret a signal from the igniter to determine whether the high voltage should be induced across the gap to create the spark or a flame is present in the burning chamber.

17 Claims, 16 Drawing Sheets

AUTOMATED TORCH

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to torches and, more particularly, to a torch capable of automated flame ignition.

2. Background Art

Torches, and, more particularly, what are known in the art as tiki torches have been used for thousands of years by inhabitants of the South Pacific Islands and other areas as a source of light. While tiki torches may still be relied upon for light by some, many use the tiki torches of today as decorative pieces that not only provide a source of light but also enhance the landscape of a home, building, hotel and the like.

Many different types of torches are in use today. There are inexpensive tiki torches that may be purchased at a local store and placed around the yard of a home to enhance the landscape or to light a path. Often these torches are manufactured of inexpensive materials such as wood and like materials and typically are not manufactured to withstand weather elements for an extended period of time. Generally the structure of these types of torches will last for a few years before replacement is needed. There are also tiki torches that are manufactured of other material such as steel and like metals that are designed to last longer than their less expensive wood counterparts.

Fuel for the torches may be petroleum based and often burn quite dirty thus depositing unsightly black soot on the outside of the heads of torches as well as sending harmful pollutants into the atmosphere. Igniting the torches may be a chore as well. Typically, the torches must be hand lit with matches and the like, which may take a considerable amount of time if there are a number of tiki torches on the grounds such as at a hotel. Once lit, torches will tend to extinguish under a heavy wind or rain or when the fuel is exhausted and the chore of relighting the torches begins again.

Torches have been developed that are capable of self igniting once they have become extinguished. However, these torches require the use of computer systems that are generally quite large and cannot be wholly contained in the torch itself thus leading to an unsightly addition to the landscape. Many of today's torches continue to rely on petroleum based products as fuel which continue to create unsightly deposits on the heads of torches as well as spewing harmful pollutants into the atmosphere.

Therefore, a need exists for an automated torch that is capable of re-igniting the flame when the flame is unexpectedly extinguished by wind, rain and the like. A need also exists for a completely self contained unit, apart from the fuel source, such that the torches remain aesthetically pleasing while being completely functional. A further need still exists for a torch that is capable of operating with fuels that burn very clean for appearance as well as environmental purposes.

BRIEF SUMMARY OF THE INVENTION

An automated torch for generating and sustaining a flame is provided that includes a head, the head including a burning chamber, the burning chamber being open to the atmosphere and weather elements to expose the flame to the atmosphere and weather elements, a pole, a valve, a programmable computer module, the module configured to convert a low voltage to a high voltage, the module further configured to actuate a valve, the module still further configured to control the valve to vary the amount of fuel introduced into the burning chamber to modify the aesthetics of the flame, a sleeve nut, the sleeve nut configured to be adjustable to control the amount of air introduced in the burning chamber to modify the aesthetics of the flame, at least one fuel supply tube, a diffuser assembly and an igniter. The igniter positioned within the burning chamber and the igniter including an anode and a cathode. The anode and the cathode are positioned such that the anode is proximate the cathode to create a sufficient gap such that when the high voltage is applied to said igniter a spark is induced across the gap. The anode and the cathode of the igniter are configured to detect the presence of a flame within the burning chamber. The igniter is configured to be electrically connected to the programmable computer module, the programmable computer module programmed to interpret a signal from the igniter to determine whether the high voltage should be induced across the gap to create the spark or a flame is present in the burning chamber.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
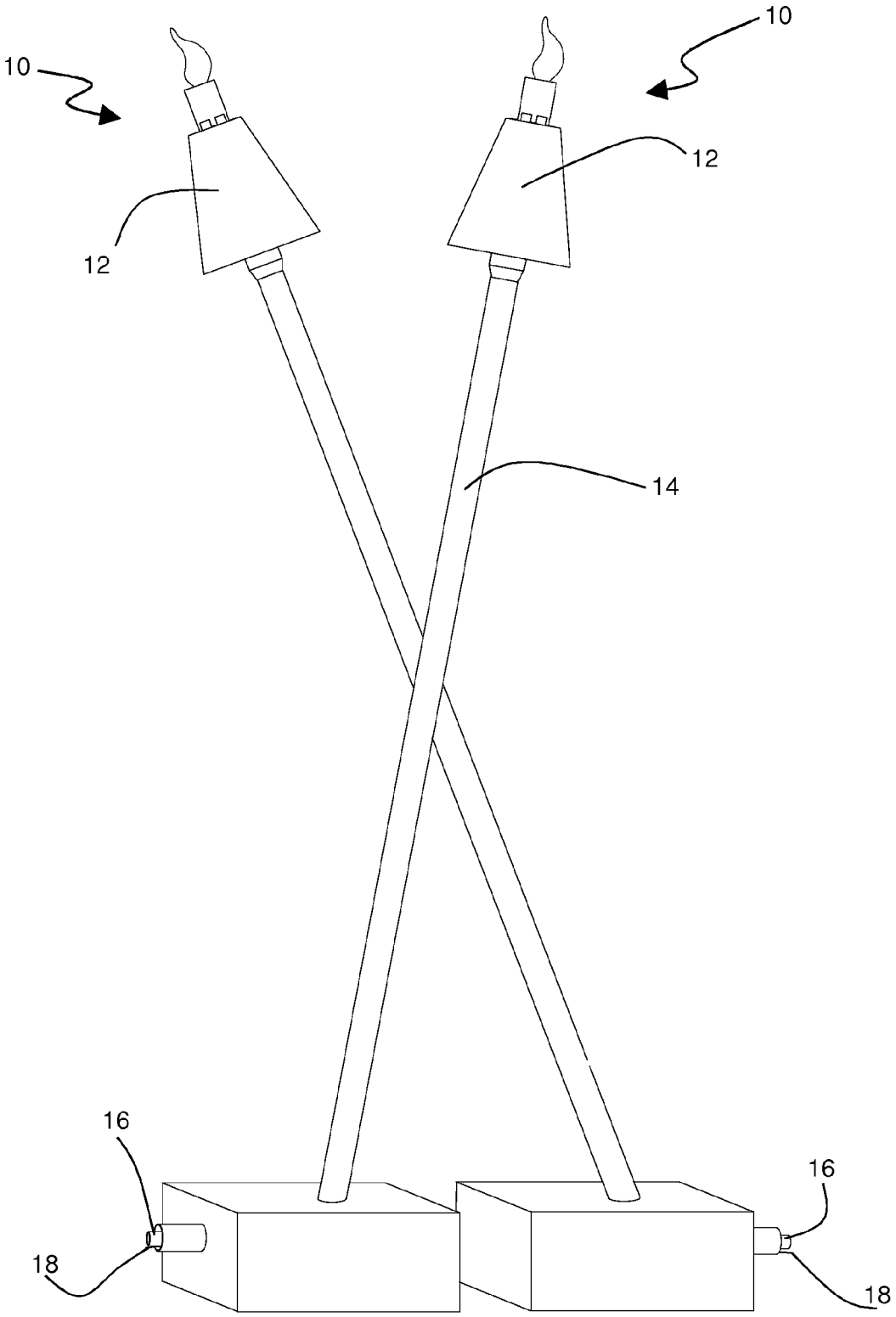
FIG. 1 is a perspective view of automated torches according to an embodiment of the present invention.

Referring now to the drawings, preferred illustrative embodiments of the present invention are shown in detail. Although the drawings represent embodiments of the present invention, the drawings are not necessarily to scale and certain features may be exaggerated to better illustrate and explain the present invention. Further, the embodiments set forth herein are not intended to be exhaustive or otherwise to limit or restrict the invention to the precise forms and configurations shown in the drawings and disclosed in the following detailed description.

Now referring to the drawings, an automated torch 10 is illustrated in FIGS. 1-5. According to an embodiment of the present invention, torch 10 includes a head 12 and a pole 14. Head 12 will contain many of the features that will control the operation of torch 10. These features will be more fully described below. Pole 14 contains still further features for the operation of torch 10 as well as providing a rigid structure to support head 12 and torch 10.

Figure 2:
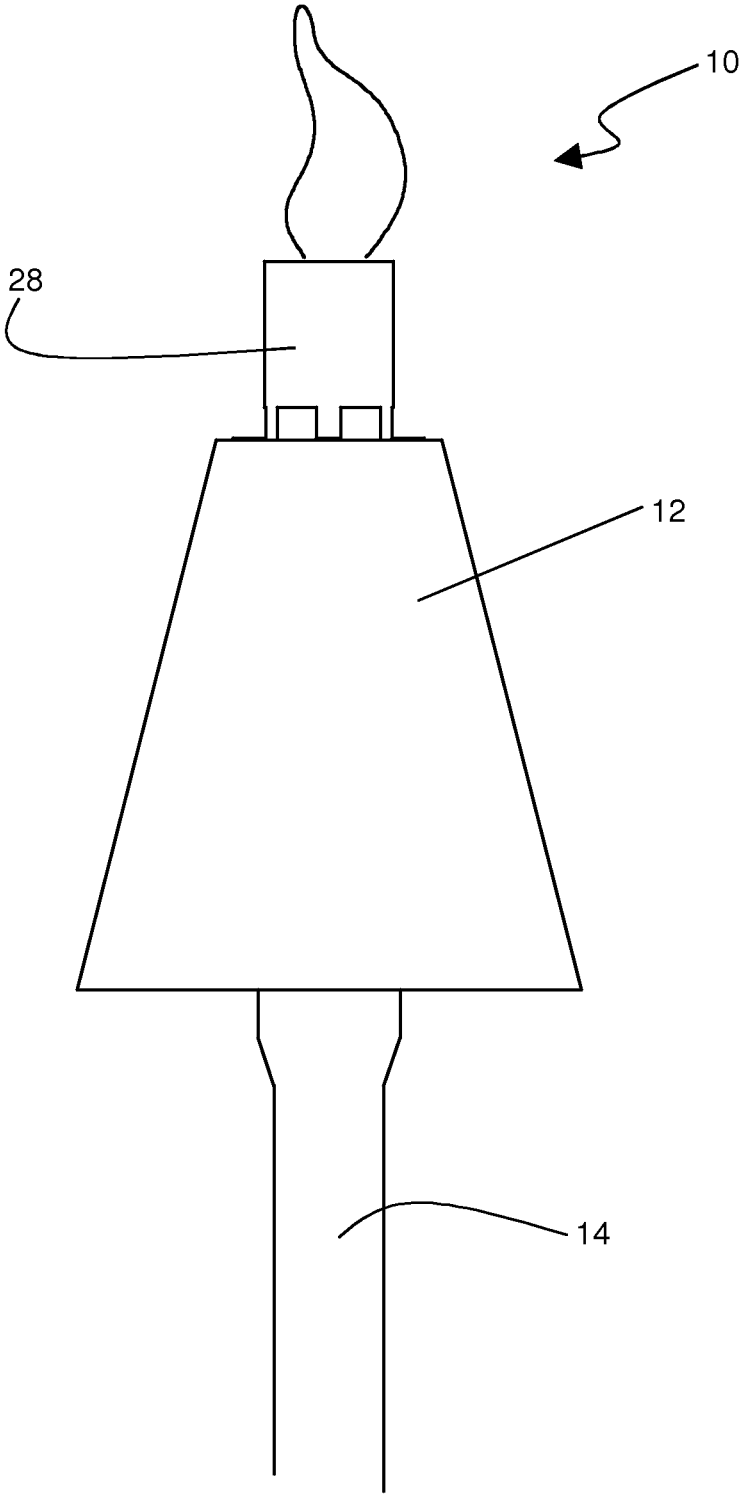
FIG. 2 is an enlarged front view of a head and of a pole of the automated torch according to an embodiment of the present invention.

FIG. 2 illustrates an enlarged view of head 12. In this particular embodiment of the present invention, the shape of head 12 is that of a traditional tiki torch. Typically, a traditional tiki torch design is an inverted cone shape that includes a squared off top transitioning into a cylinder for housing the ignition source. It is important to note, however, that the torch may have a head 12 constructed of virtually any design, yet still maintain the general basis of the invention. Samples of other torch designs are illustrated in FIGS. 6-12.

Figure 4A:
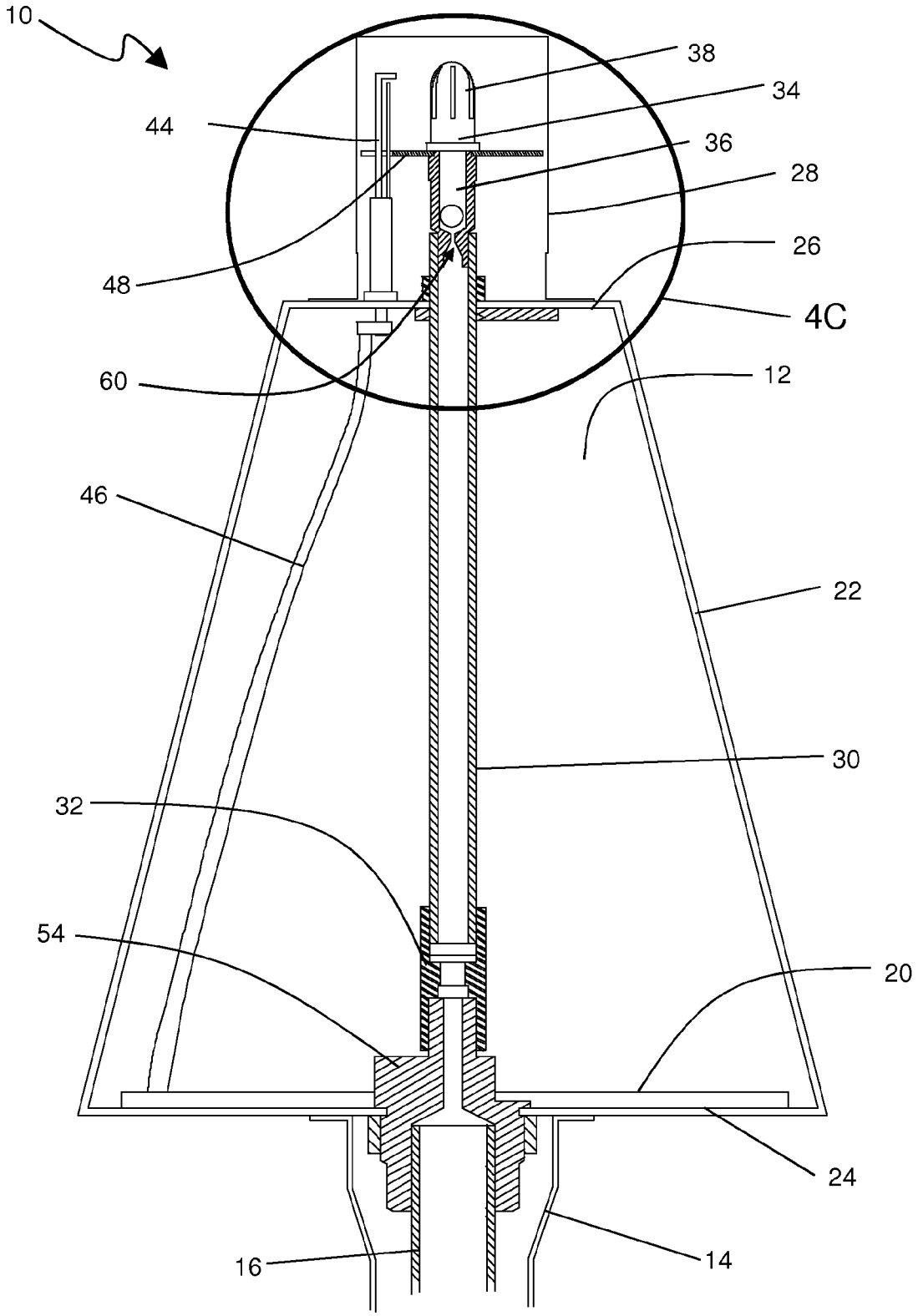
FIG. 4A is an enlarged cross-sectional view of the head and the pole of the automated torch according to an embodiment of the present invention.
Figure 4B:
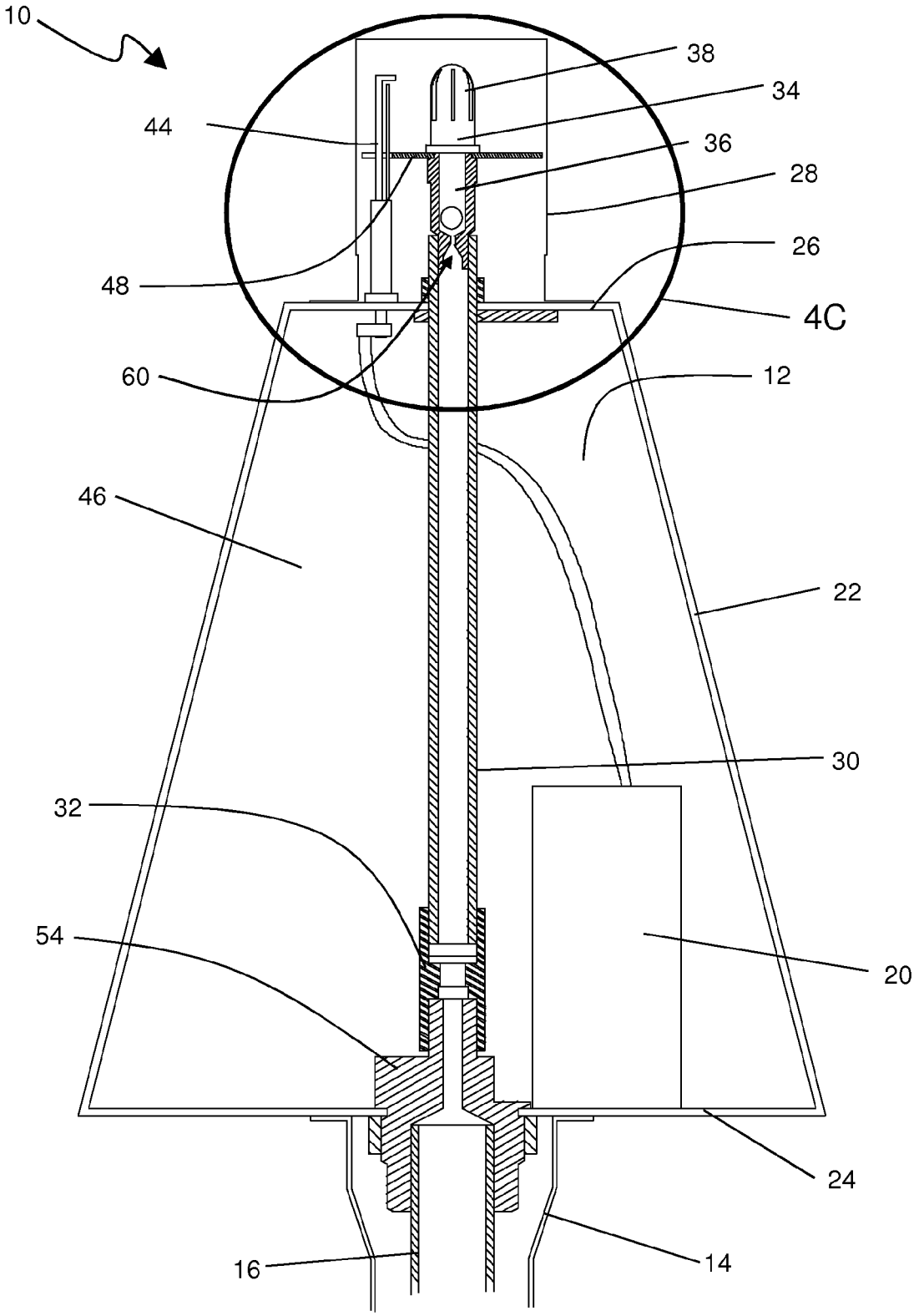
FIG. 4B is an enlarged cross-sectional view of a head and the pole of the automated torch according to another embodiment of the present invention.
Figure 4C:
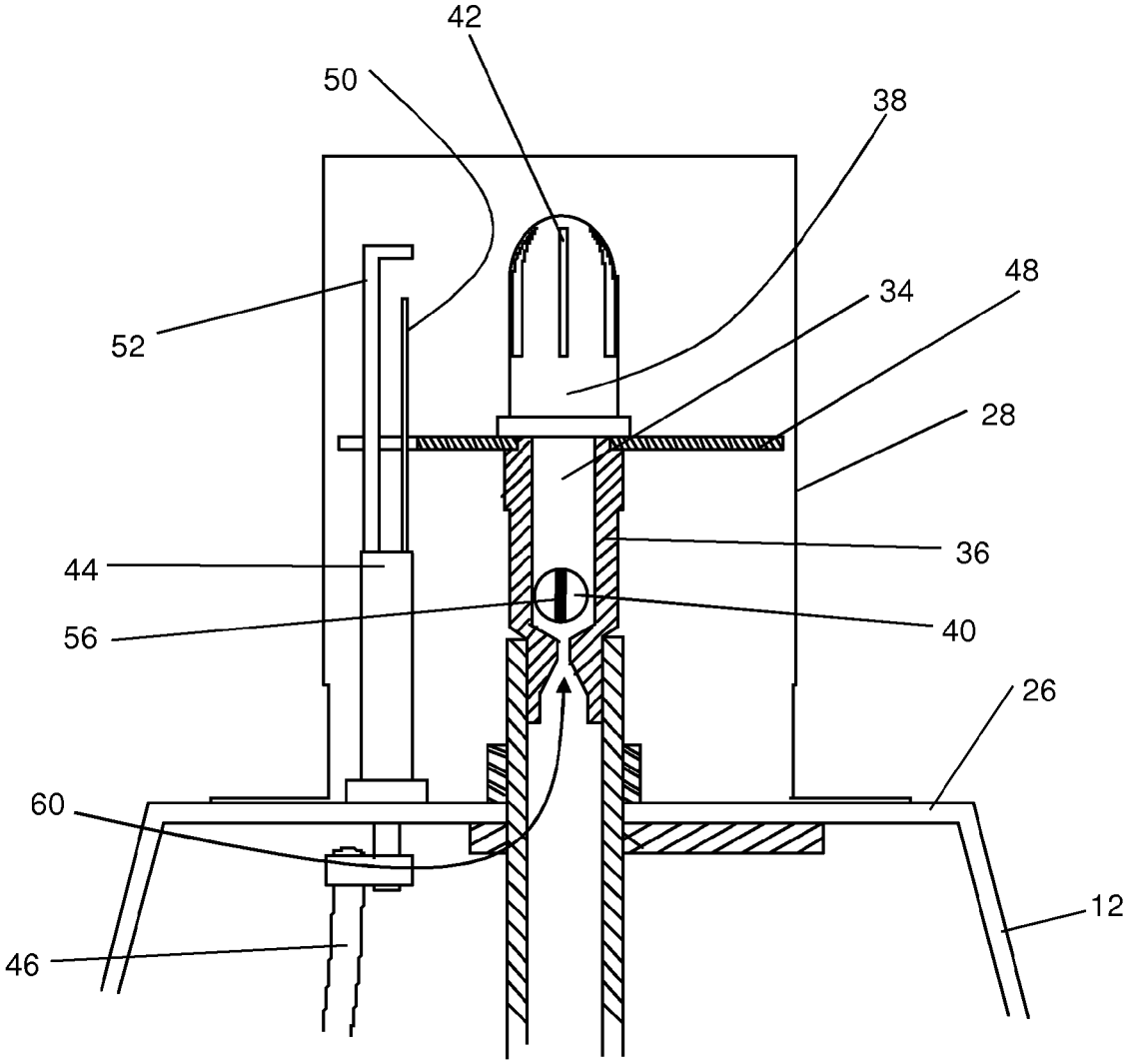
FIG. 4C is an enlarged cross-sectional view of the head and a burning chamber of FIG. 4A of the automated torch according to an embodiment of the present invention.
Figure 4D:
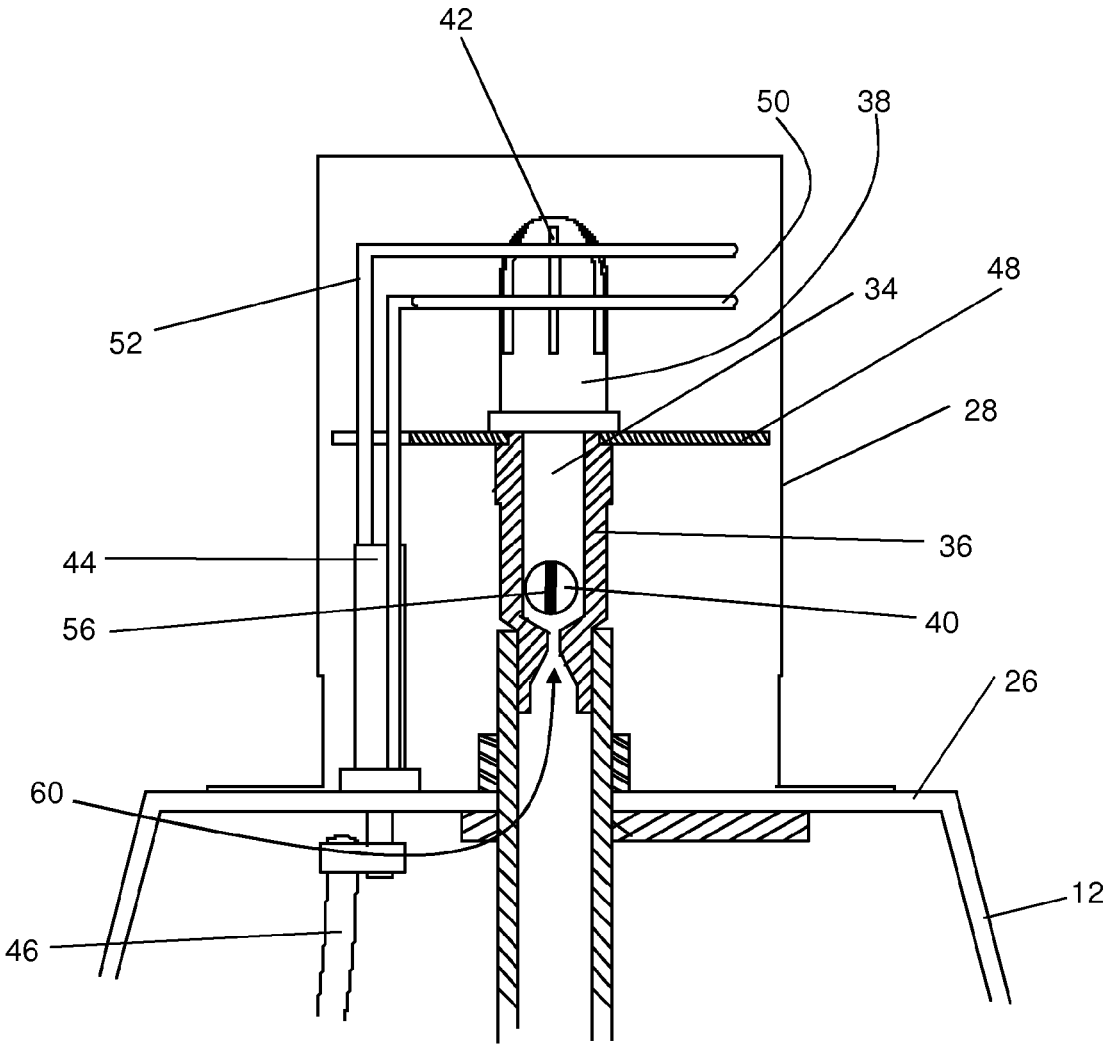
FIG. 4D is an enlarged cross-sectional view of the head and a burning chamber of the automated torch according to yet another embodiment of the present invention.
Figure 5:
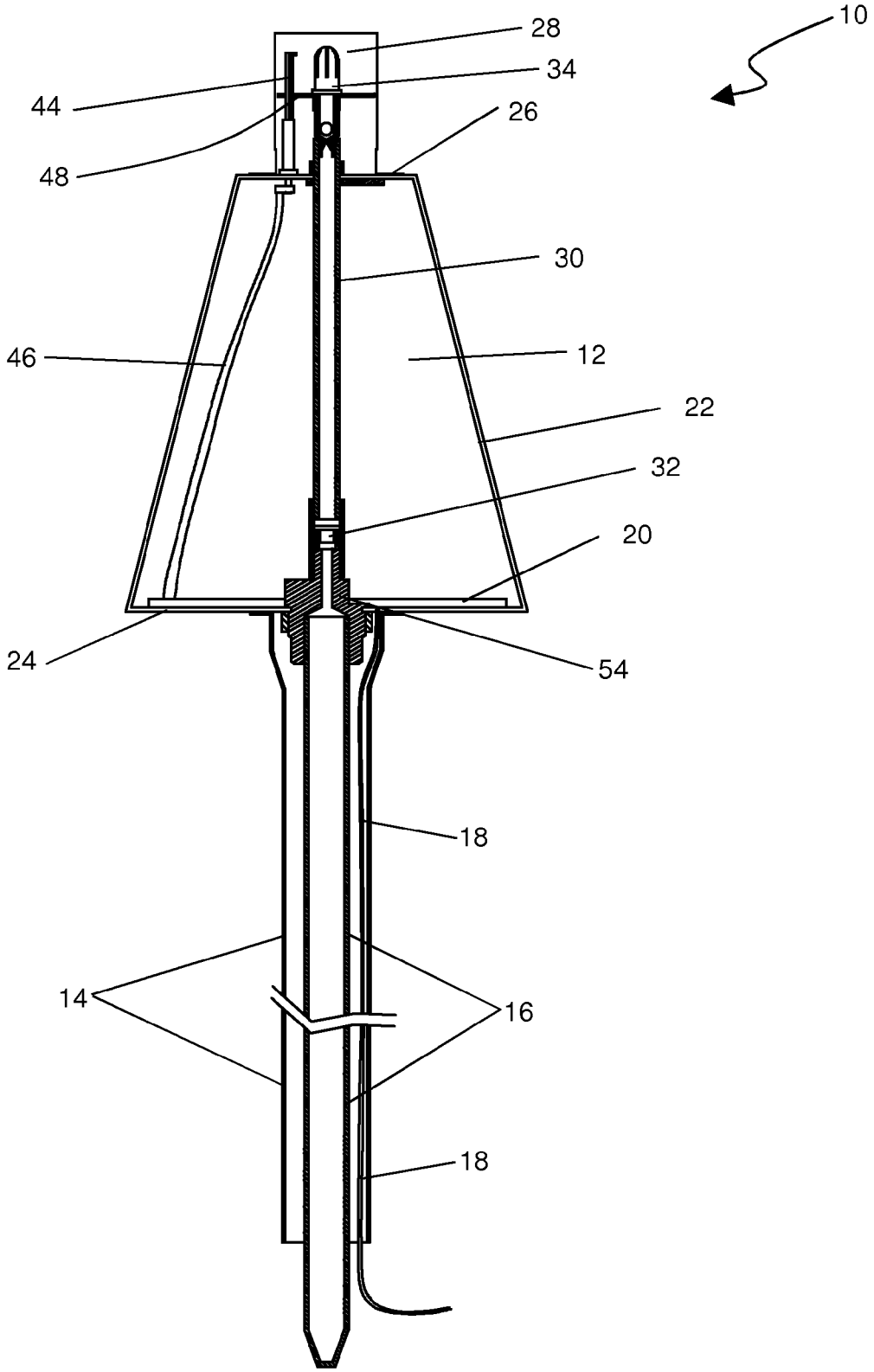
FIG. 5 is a cross-sectional view of the automated torch according to an embodiment of the present invention.

A cross-sectional view of pole 14 is also illustrated in FIGS. 4A-5. Pole 14 may be manufactured of any material that will be aesthetically pleasing to the owner while providing a rigid mount for the entire of torch 10 and head 12. Pole 14 may be manufactured of copper, stainless steel, steel wrapped with roping and the like. Pole 14 generally houses a gas pipe 16 that extends from a gas supply source (not shown) to head 12. Pipe 16 supplies a source of fuel to torch 10 as one component of creating a flame. Fuel may be from any source such as natural gas, propane and the like. In other embodiments of the present invention to be discussed later, pole 14 may be sized to house other components of torch 10. Pole 14 may also house electrical wires 18 that extend from an electrical source (e.g. a 24 volt supply) and through pole 14 to a computer module 20 that is used to operate torch 10.

Figure 8:
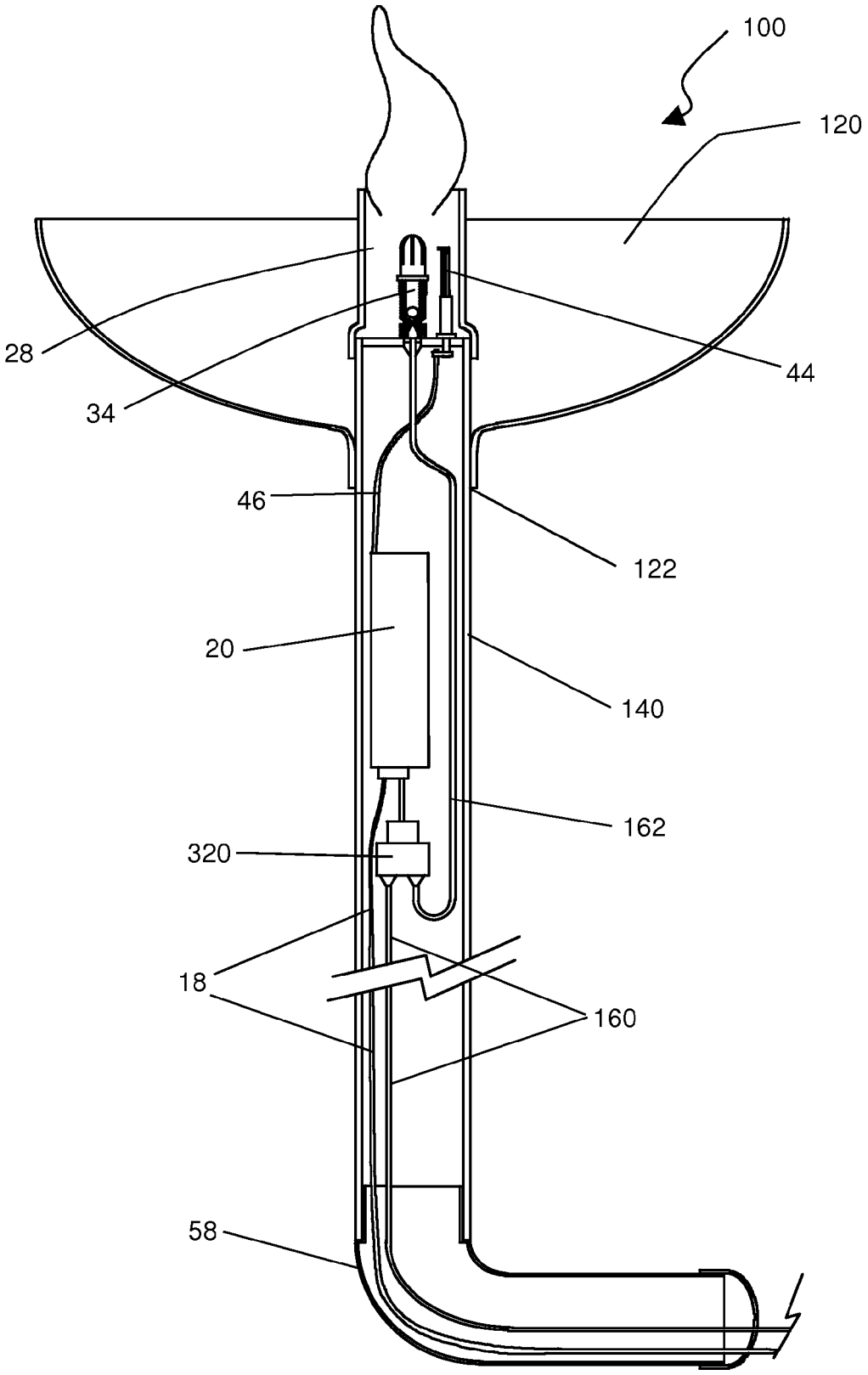
FIG. 8 is a cross-sectional view of the automated torch according to an embodiment of the present invention.

As stated above, pole 14 and pipe 16 provide a rigid support for torch 10 and head 12 and may be constructed to withstand the elements of wind, heat, cold and precipitation. Pole 14 may be anchored to the ground by sinking pole 14 directly into the earth, setting pole 14 into a concrete base, setting pole 14 into a wood base, and the like (See e.g. FIGS. 1 and 5). No matter what anchoring system is used to position and secure torch 10, a supply of gas and electricity may be brought to torch 10 through a system of underground piping 58 such as polyvinyl chloride (PVC) tubing (as shown in FIG. 8). Pipe 58 may be secured to the bottom of pole 14 by threading both ends of pipe 58 and pole 14 such that pole 14 may be screwed directly onto pipe 58. Alternatively, any type of fasteners, such as screws, may be used to secure pole 14 to pipe 58 to provide a pathway for pipe 16, wires 18 and any other component that may travel from a source (electrical box, gas supply, etc.) to torch 10 ultimately to be used to create a flame at head 12. A standard manual ball valve (not shown) may be added to pipe 16 near the base so that the flow of gas may be manually controlled at torch 10.

A cross-sectional view of head 12 is illustrated in FIGS. 4A-5 as well. In this particular embodiment of the present invention, head 12 includes sidewalls 22 that have been fashioned in the shape of a cone, a bottom plate 24 that intersects sidewalls 22 at a bottom of head 12, a top plate 26 that intersects sidewalls 22 at a top of head 12. A cylindrical top component that creates a burning chamber 28 extends generally outward from top plate 26.

The interior of head 12 may house many of the components that are used in the operation of torch 10. Computer module 20 may be encased within head 12 and may be generally positioned anywhere within head 12. In this particular embodiment of the present invention, module 20 is positioned such that it is proximate bottom plate 24. Also housed within head 12 is a pipe 30 that extends from near bottom plate 24 through top plate 26 and into burning chamber 28. A pipe fitting 54 connects pipe 30 with gas pipe 16. In this particular embodiment of the present invention, pipe 16 may be ¾" in diameter and pipe 30 may be ¼" in diameter, therefore, fitting 54 may be sized to make the transition from the larger diameter pipe 16 to the smaller diameter pipe 30. One skilled in the art would appreciate the transition to a smaller diameter pipe to enable critical package space within head 12 while maintaining an adequate supply of fuel to the flame. Further contained within the interior of head 12 is a valve 32 that may be integrated into pipe 30 and may be electrically controlled by module 20 to vary the flow of fuel from the gas supply to head 12 of torch 10.

Referring now to chamber 28 of head 12, a diffuser assembly 34 is positioned and secured to pipe 30 near the top of pipe 30. Diffuser 34 includes a stem 36 and a cap 38. Stem 36 may include a plurality of holes 40 to allow for atmospheric air to enter stem 36 and mix with fuel from pipe 30 in stem 36. Stem 36 may include a venturi hole 60 that may be sized such that a typical venturi effect may be created between stem 36 and pipe 30 to draw outside air or oxygen through holes 40 and into stem 36 to mix with the fuel. The amount of fuel entering stem 36 may be controlled by varying the size of hole 60. The amount of air or oxygen entering stem 36 may be controlled by the size of holes 40 as well as by introducing a sleeve nut 56 into holes 40 that may be adjusted to control the flow of air. Controlling the amount of air or oxygen and the amount of fuel that is introduced into stem 36 will allow for the adjusting of the flame aesthetics (e.g. controlling flame height). Cap 38 may include a number of slots 42 to allow fuel, such as natural gas, and air mixture to escape from pipe 30 such that it may be used to create a flame when ignited. Cap 38 may include any number of slots to create the desired flame pattern that is most aesthetically pleasing.

Also included within chamber 28 is means for igniting the fuel. In this particular embodiment of the present invention, an igniter 44 may be attached to top plate 26 of head 12 and extends into chamber 28. Igniter 44 is generally known by those skilled in the art and may include an anode 50 and cathode 52. Anode 50 and cathode 52 are generally positioned proximate one another yet insulated from each other by ceramic or other material. Anode 50 and cathode 52 are designed in igniter 44 such that a gap is created between them. When a voltage is applied to igniter 44, a spark will be induced across the gap between anode 50 and cathode 52 to complete the electrical circuit. The amount of voltage required to cross the gap is dependant of the size of the gap as well as the materials used in the igniter. Igniter 44 may be positioned proximate diffuser 34 such that a spark created by igniter 44 across the gap will ignite the fuel escaping from pipe 30 through diffuser 34 to create a flame. Igniter 44 is attached to module 20 by a high voltage cable 46. Igniter 44 is connected to module 20 in this manner such that module 20 may control the operation of igniter 44.

Furthermore, anode 50 and cathode 52 of igniter 44 may be a flame detection sensor as well for ensuring that a flame is present to burn the fuel from pipe 30 by detecting the rise in temperature that a flame provides versus the absence of a flame. This change in temperature caused by the existence or absence of flame induces a voltage change in igniter 44. Igniter 44 may provide voltage information to module 20 through the electrical connection between igniter 44 and module 20, thus providing module 20 with the information of whether a flame is present.

Figure 3A:
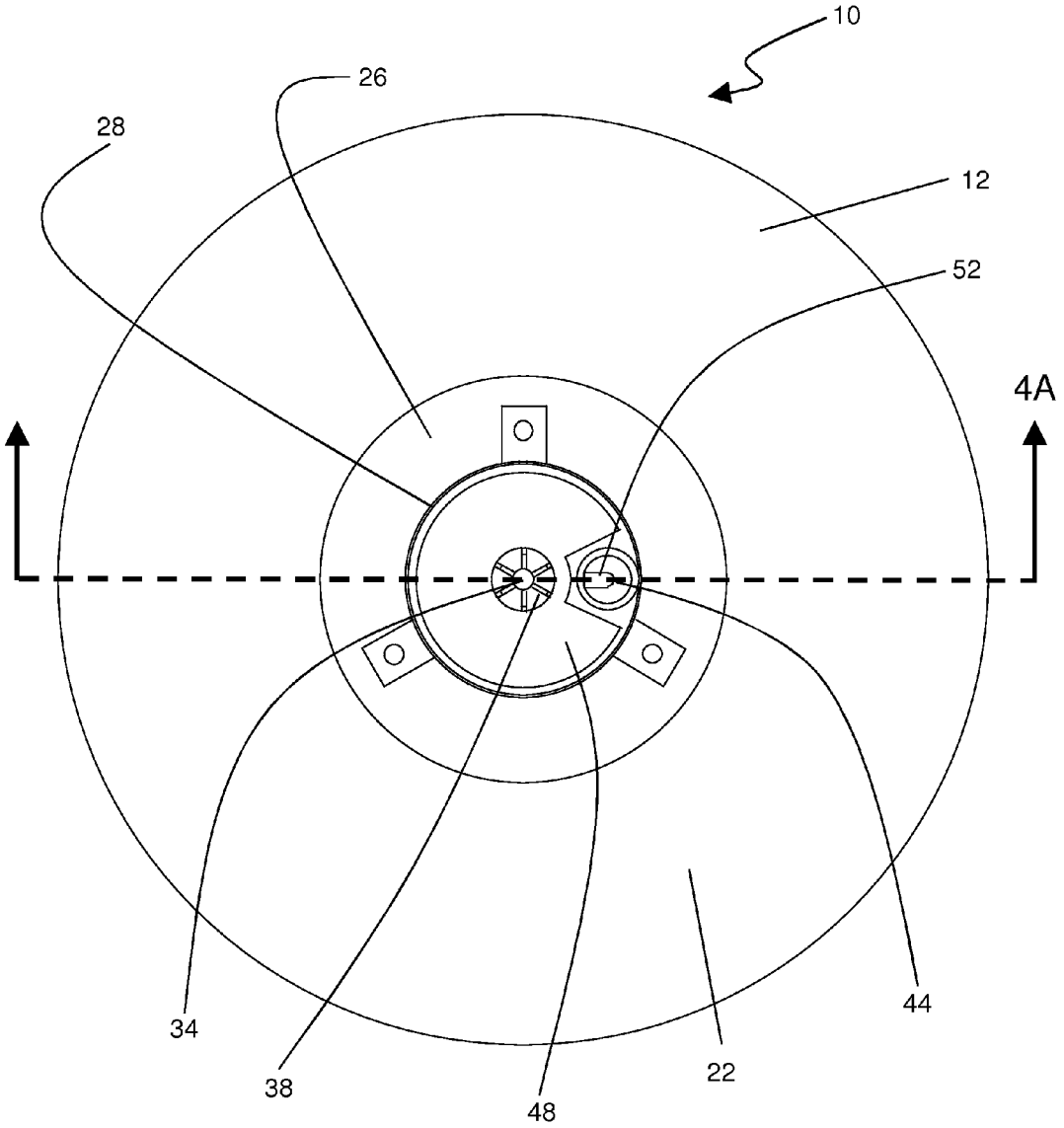
FIG. 3A is top view of the automated torch according to an embodiment of the present invention.
Figure 3B:
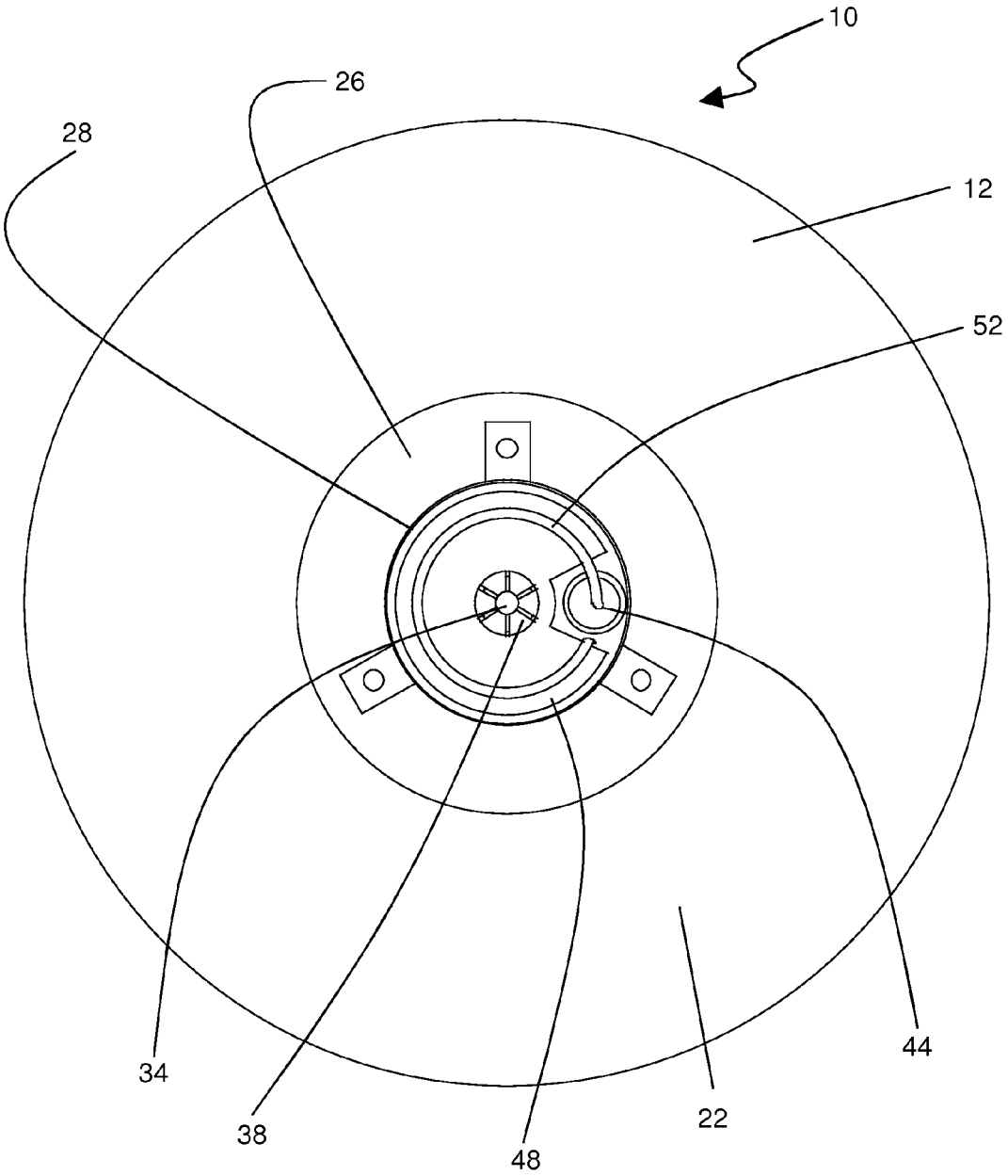
FIG. 3B is top view of the automated torch according to another embodiment of the present invention.

In another embodiment of the present invention anode 50 and cathode 52 of igniter 44 may be designed such that anode 50 and cathode 52 encircle diffuser assembly 34 as illustrated in FIGS. 3B and 4D. Anode 50 and cathode 52 will still be separated as described above such that when a voltage is applied to igniter 44, a spark will be induced across the gap between anode 50 and cathode 52 to complete the electrical circuit and ignite any fuel that may be present in burning chamber 28. Anode 50 and cathode 52 may continue to be a flame detection sensor as well, a flame detection sensor that encircles diffuser assembly 34 and much of chamber 28. Anode 50 and cathode 52 be designed in this manner to detect any flame that may be present within chamber 28. For example, a strong wind may blow across chamber 28 forcing any flame that is present to one side of burning chamber 28, opposite the side of the burning chamber where igniter 44 (as shown in FIG. 4C for example) is positioned. The flame may be at a location in chamber 28 due to a strong wind such that igniter/flame detection sensor 44 may send a voltage to module 20 stating that the flame has been extinguished when, actually, the flame is still present. Providing a design where anode 50 and cathode 52 may encircle diffuser 34 and circle the interior of chamber 28 will help to ensure a proper flame detection for a flame that may be present in any part of burning chamber 28.

Burning chamber 28 may also include a plate 48 that encircles stem 36 and extends to near the interior surface of chamber 28. Plate 48 may be designed to prevent wind, rain, snow and other weather elements from disrupting the air flow entering holes 40. Disrupting the control of air flow into chamber 28 and stem 36 (either too much air or too little air) will have an effect on flame production as described above. Plate may also be used to aid in preventing large pieces of debris from entering chamber 28 and disrupting air flow into burning chamber 28 and ultimately stem 36. Plate 48 may be made of any suitable material such as metal, plastic, ceramic and the like.

Now referring to the operation of torch 10, computer module 20 contains circuitry for operating torch 10. Once positioned and electrical and gas tubing connections have been made, a continuous supply of fuel, such as natural gas, propane, and the like, may be fed to torch 10 from the source. Power or electricity, generally from a typical 24-volt power supply, may be delivered to torch 10 through wires 18 as long as the source of electrical power is providing the electricity. This electricity will power module 20, valve 32 and igniter 44 thus allowing for the full operation of torch 10.

Torch 10 may be operated by module 20 through the use of a computer program or code. The computer program may be written such that module 20 may control the flow of fuel through pipe 16, pipe 30 and out of diffuser assembly 34 by opening and closing valve 32 of pipe 30. The computer program may also contain code or programming language that controls the operation of igniter 44. Module 20 may receive voltage data or information from igniter/sensor 44 and module 20 may infer from the data whether a flame is present or not and based on this data, determine whether to activate igniter.

With both sources of fuel and electricity fully operational, torch 10 may be activated in the following manner. Fuel will be flowing through gas pipe 16 to valve 32. A switch (not shown) may be engaged to direct electrical power to module 20. Once energized, module 20 may open valve 32 that will allow the flow of fuel through pipe 30 and out of diffuser assembly 34. Igniter/sensor 44 will also be operational and determine whether there is a flame present to burn the fuel by detecting heat. If the voltage is not at a specified threshold for flame presence, module 20 will activate igniter 44 by sending a high voltage through cable 46. The voltage will be at a level such that a spark will be induced across the anode 50 and cathode 52 of igniter 44. This spark will ignite the fuel traveling trough pipe 30 and out of diffuser 34 to create an aesthetically pleasing flame.

Once a flame has been created in torch 10, the flame will remain lit until the fuel supply if turned off and/or the electrical supply is interrupted. If, however, the flame of torch 10 is extinguished by wind, precipitation or other means, the voltage at igniter/sensor 44 will change and module 20 will detect that the voltage from igniter/sensor 44 has fallen below a specified limit (i.e. there is no flame present in chamber 28). If this occurs, module 20 will again send a high voltage signal to igniter 44 in an attempt to create a spark across the gap thus igniting the fuel and return a flame to torch 10. Each time the flame is extinguished by wind, precipitation and other means, torch 10 will continue to relight itself until the fuel supply is shut-off and/or the electrical supply is terminated. Module 20 of torch 10 may be programmed to cycle through the relighting phase each time the flame is extinguished or, alternatively, the flame cannot be lit due to excessive wind or precipitation. For example, a cycle may consist of attempting to relight the torch for a 30 second period. If the flame is not relit, the module may turn off the fuel and igniter for a period of time, such as 15 seconds, then turn the fuel back on and attempt to light the torch for another 30 second period. This cycle may continue for a specified time prior to the system shutting down for an extended period of time such as five minutes before continuing the reigniting cycle once again.

As stated above, the aesthetics of the flame may be controlled by the amount of atmospheric air or oxygen and the amount of fuel being drawn into stem 36. If a larger flame is desired, the amount of air being drawn into stem 36 may be reduced dramatically such that little or no air is being mixed with the fuel. The holes may be closed off by adjusting sleeve nut 56 into holes 40. Alternatively, venturi hole 60 may be enlarged to allow for more fuel to enter stem 36. With little or no air mixing with the fuel, torch 10 will produce a larger flame that is burning almost exclusively from the fuel supplied to torch 10. While the larger flame may be aesthetically pleasing, it does, however, have drawbacks. For instance, fuel consumption increases greatly versus burning a fuel/air mixture as well as the emissions produce by the burning fuel. Air may be introduced to both reduce fuel consumption and emissions, yet a smaller flame may be produced. There may also be an amount of air that may be drawn into stem 36 such that all the fuel may be burned by the flame and effectively reducing harmful emissions to zero. Fuel consumption, flame height as well as flame color are all adjustable by changing the amount of air or oxygen entering stem 36 though holes 40 and changing the amount of fuel introduced into stem 36 by modifying the size of hole 60, thus altering the fuel/air mixture.

While the above embodiment of the present invention has been described through the use of a commonly used tiki torch design, it is important to note however, that torch 10 may be manufactured in other designs. Each of the designs described below will all have the same common concepts of the previous torch design, that of being automated and completely self contained but for fuel and electrical supplies.

Figure 6:
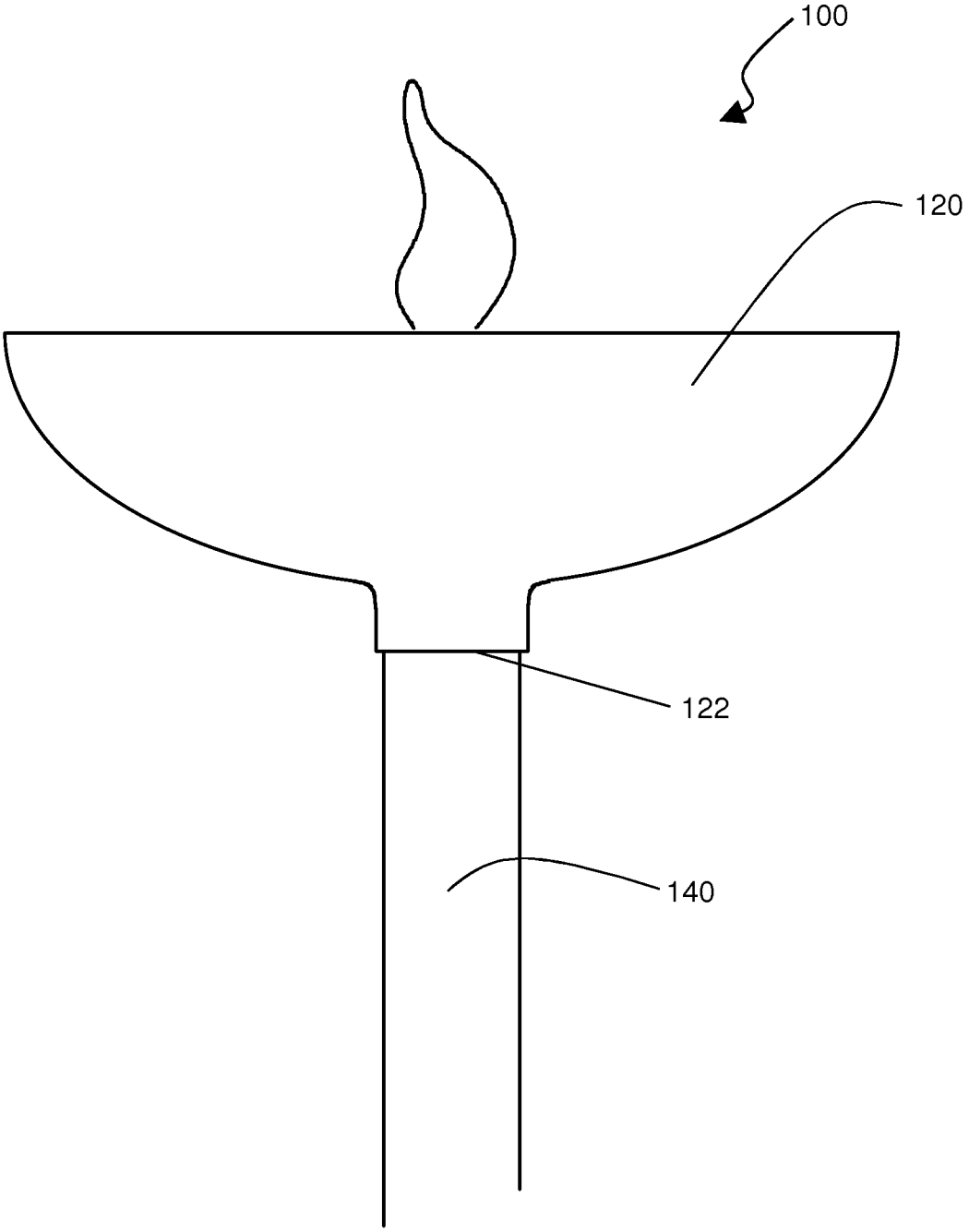
FIG. 6 is an enlarged front view of a head and of a pole of the automated torch according to yet another embodiment of the present invention.
Figure 7:
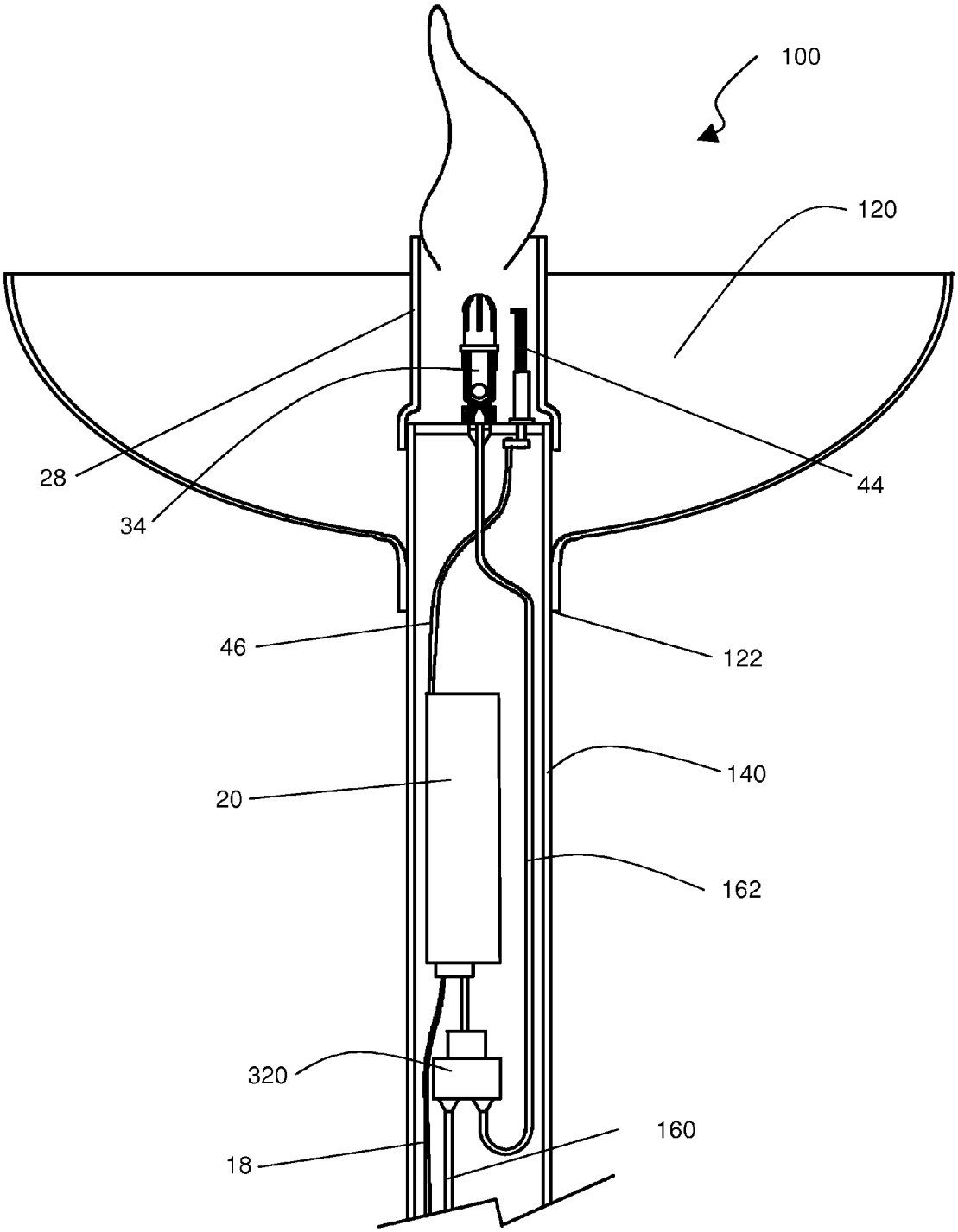
FIG. 7 is an enlarged cross-sectional view of the head and the pole of the automated torch according to an embodiment of the present invention.

In another embodiment of the present invention illustrated in FIGS. 6-8, head 120 of torch 100 is shown. In this particular embodiment, head 120 is shaped as a bowl having an opening 122 that allows for the passage of pole 140. Although torch 100 exhibits a different head 120 design, it is important to note that many of the components of torch 10 are also included in torch 100. Gas tube 160 extends from a gas supply through pole 140 to a valve 320. Electrical wiring 18 extends from a electrical source to computer module 20. In this particular embodiment of the present invention, module 20 may be positioned with in pole 140 versus head 12 of torch 10. The location change of module 20 may be for package reasons and operates in much the same manner as module 20 of torch 10.

A second gas tube 162 extends from valve 320 to diffuser assembly 34, diffuser assembly 34 being positioned within burning chamber 28. Igniter 44 is also positioned within chamber 28 and is proximate to diffuser 34. Igniter/sensor 44 is also connected to module 20 by high voltage cable 46.

Torch 100 will operate in much the same manner as torch 10. Fuel will be supplied to torch 100 through gas tube 160 to valve 320. An electrically energized module 20 will open valve 320 to allow fuel to flow through tube 162 and into diffuser 34 and out to the open atmosphere. Igniter/sensor 44 will provide a voltage reading to module 20 and if the voltage is below a set threshold, module 20 will send a high voltage signal to igniter 44 to induce a spark across the gap created by the positioning of anode 50 and cathode 52. The spark will ignite the fuel and create an aesthetically pleasing flame.

Figure 9:
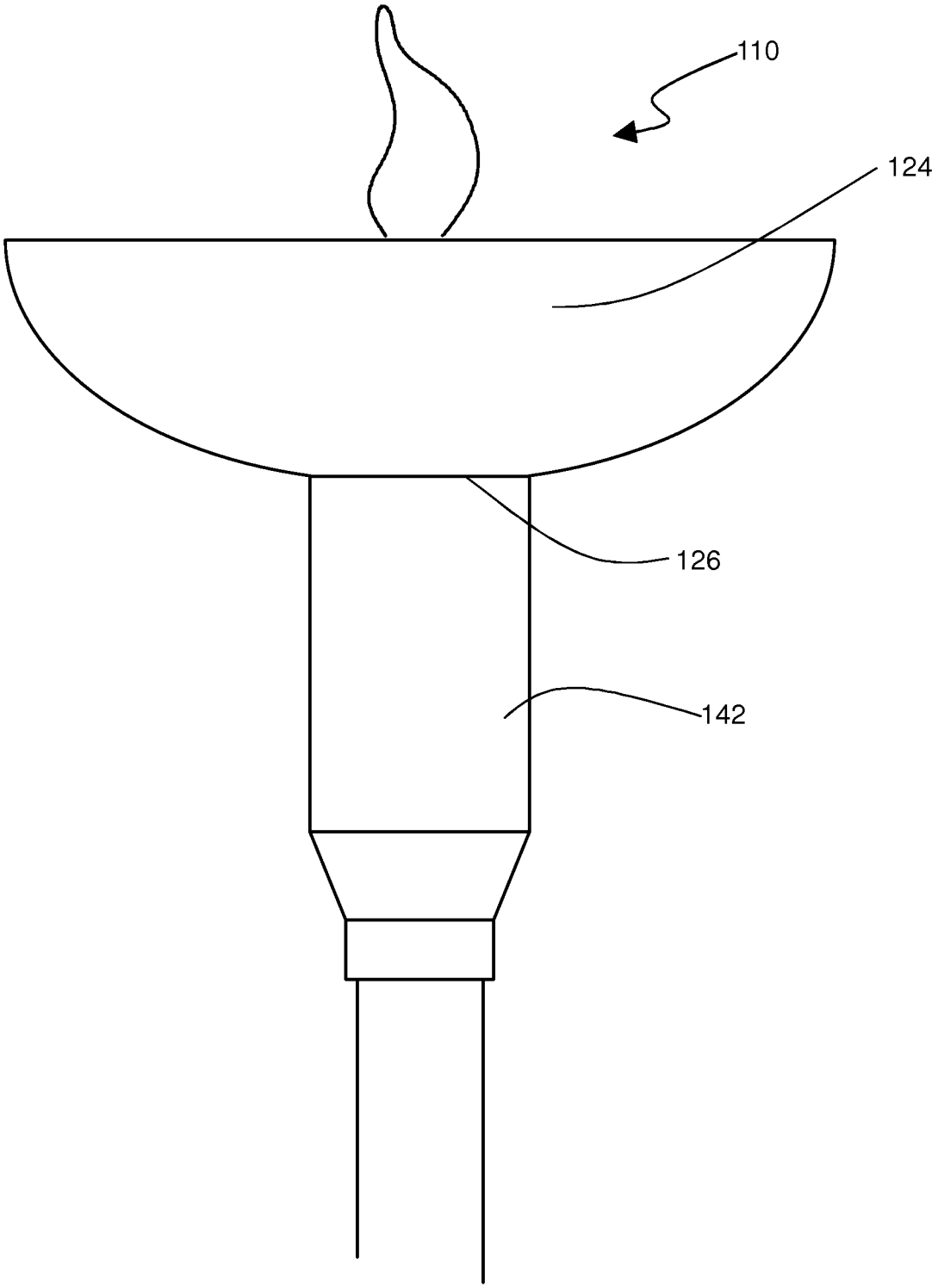
FIG. 9 is an enlarged front view of a head and of a pole of the automated torch according to still another embodiment of the present invention.
Figure 10:
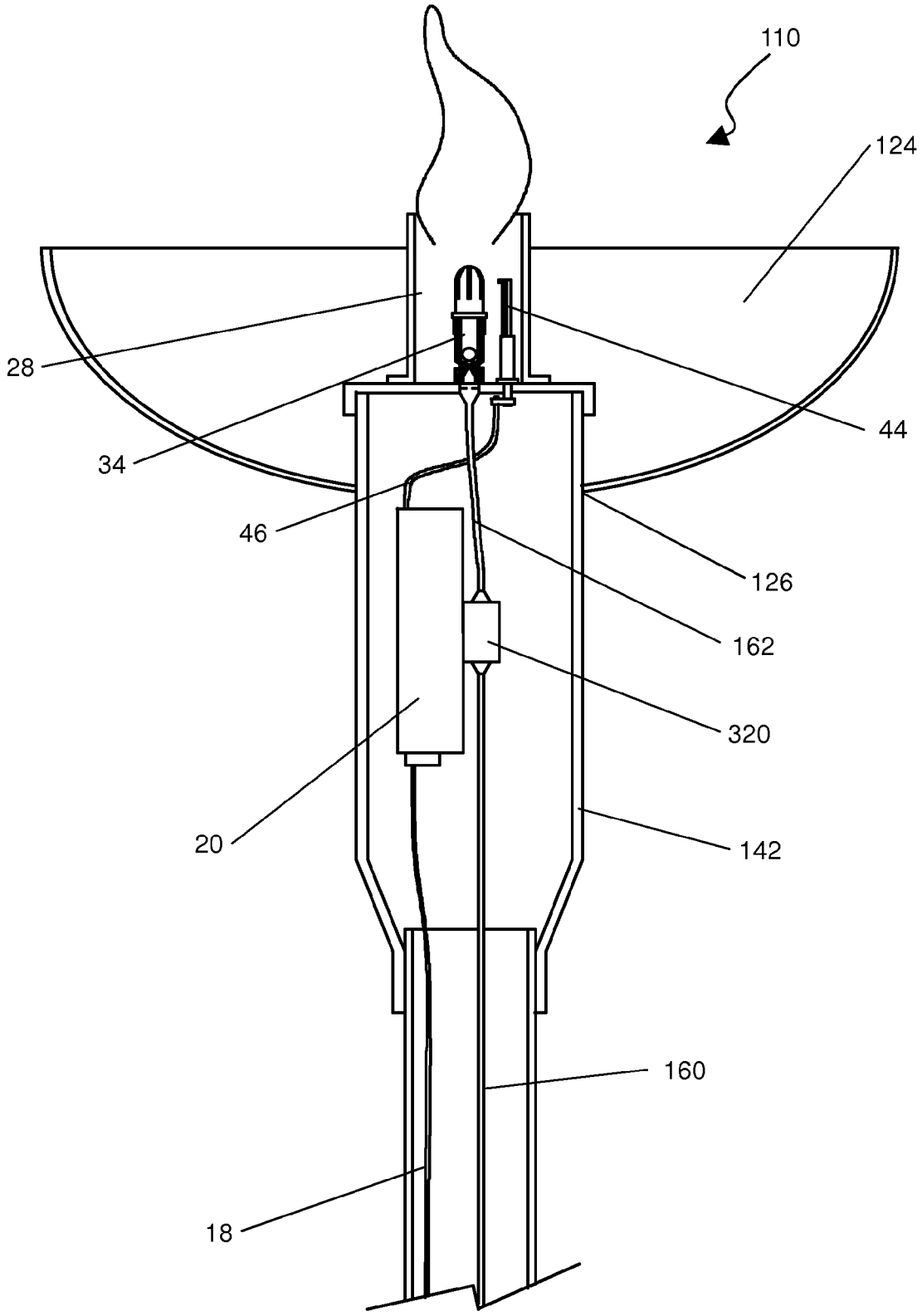
FIG. 10 is an enlarged cross-sectional view of the head and the pole of the automated torch according to embodiment of the present invention.

In yet another embodiment of the present invention illustrated in FIGS. 9 and 10, torch 110 is shown with a pole 142 having a taper near the top as pole 142 enters head 124. In this particular embodiment, head 124 is once again shaped as a bowl having an opening 126 that allows for the passage of pole 142. As discussed previously, although pole 142 and head 124 may be of a slightly different design from pervious torches 10 and 100, many of the components are very similar and will operate in the same fashion as first described above. In this particular embodiment, computer module 20 may be positioned in the larger tapered portion of pole 142, and electrical wiring 18 may be connected to module 20. Gas tube 160 extends the length of pole 142 from the fuel supply to valve 320. Second gas tube 162 extends from valve 320 to diffuser assembly 34, diffuser assembly 34 once again being positioned in burning chamber 28. Igniter/sensor 44 is also positioned in chamber 28 as described above.

Torch 110 will operate in much the same manner as torches 10 and 100. Fuel will be supplied to torch 110 through gas tube 160 to valve 320. An electrically energized module 20 will open valve 320 to allow fuel to flow through tube 162 and into diffuser 34 and out to the open atmosphere. Igniter/sensor 44 will provide a voltage reading to module 20 and if the voltage is below a set threshold, module 20 will send a high voltage signal to igniter 44 to create a spark across the gap created by the positioning of anode 50 and cathode 52. The spark will ignite the fuel and create an aesthetically pleasing flame.

Figure 11:
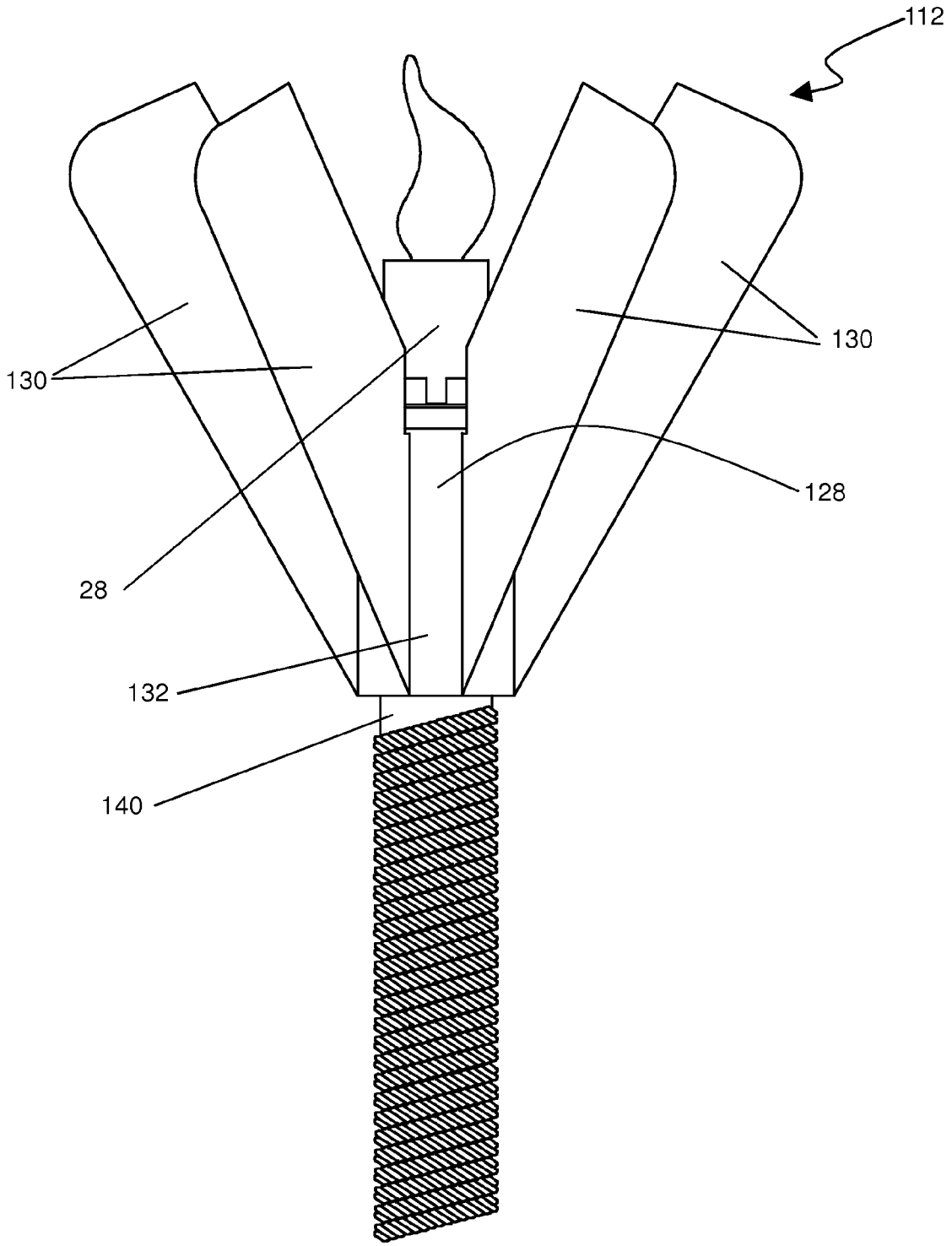
FIG. 11 is an enlarged front view of a head and of a pole of the automated torch according to yet another embodiment of the present invention.

In still another embodiment of the present invention illustrated in FIG. 11, torch 112 is shown with a head 128 having a plurality of wings 130 extending outward from a base 132 of head 128. As discussed previously, although head 128 may be of a slightly different design from pervious torches 10, 100 and 110, many of the components are very similar and will operate in the same fashion as first described above. In this particular embodiment, computer module 20 may be positioned in pole 140, and electrical wiring 18 is connected to module 20 (see e.g. FIG. 7). Gas tube 160 extends the length of pole 140 from the fuel supply to valve 320 (see e.g. FIG. 7). Second gas tube 162 extends from valve 320 to diffuser assembly 34, diffuser assembly 34 being positioned in burning chamber 28 (see e.g. FIG. 7). Igniter/sensor 44 is also positioned in chamber 28 as described above (see e.g. FIG. 7).

Torch 112 will operate in much the same manner as torches 10, 100 and 110. Fuel will be supplied to torch 112 through gas tube 160 to valve 320 (see e.g. FIG. 7). An electrically energized module 20 will open valve 320 to allow fuel to flow through tube 162 and into diffuser 34 and out to the open atmosphere (see e.g. FIG. 7). Igniter/sensor 44 will provide a voltage reading to module 20 and if the voltage is below a set threshold, module 20 will send a high voltage signal to igniter 44 to create a spark across the gap created by the positioning of anode 50 and cathode 52 (see e.g. FIGS. 4C and 7). The spark will ignite the fuel and create an aesthetically pleasing flame.

Figure 12:
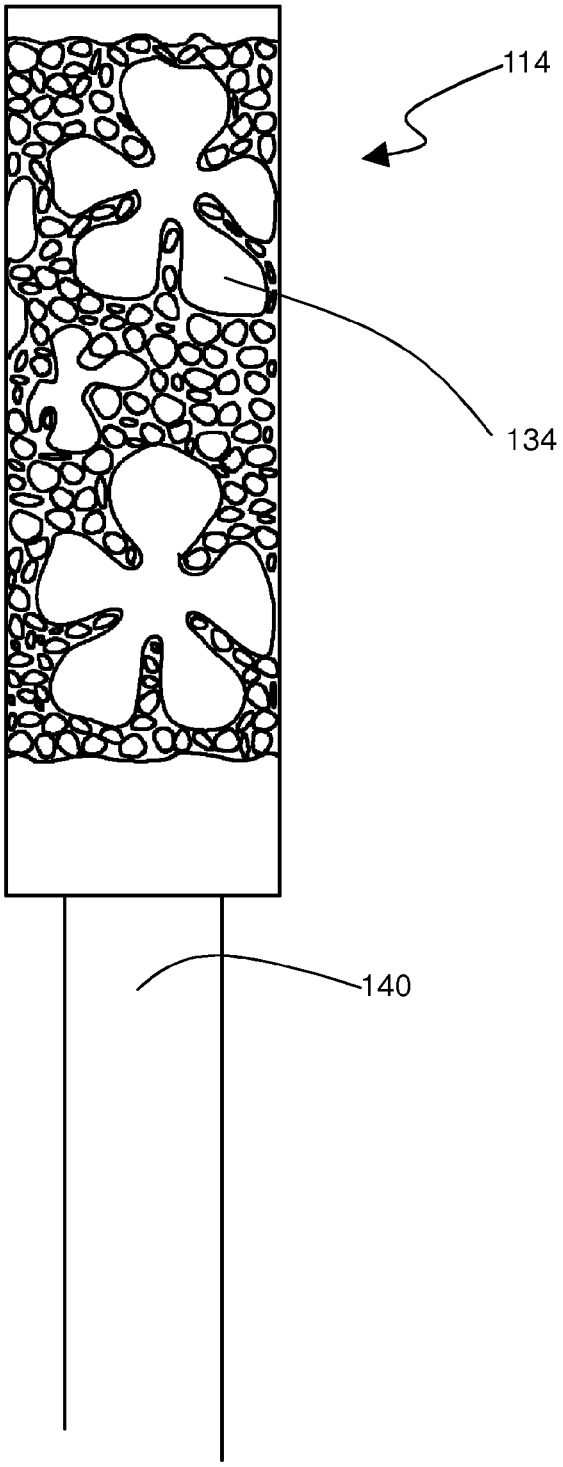
FIG. 12 is an enlarged front view of a head and of a pole of the automated torch according to still another embodiment of the present invention.

In yet another embodiment of the present invention illustrated in FIG. 12, torch 114 is shown with a decorative head 134. As discussed previously, although head 134 may be of a slightly different design from pervious torches 10, 100, 110 and 112, many of the components are very similar and will operate in the same fashion as first described above. In this particular embodiment, computer module 20 may be positioned in pole 140, and electrical wiring 18 is connected to module 20 (see e.g. FIG. 7). Gas tube 160 extends the length of pole 140 from the fuel supply to valve 320 (see e.g. FIG. 7). Second gas tube 162 extends from valve 320 to diffuser assembly 34, diffuser assembly 34 being positioned in burning chamber 28 (see e.g. FIG. 7). Igniter/sensor 44 is also positioned in chamber 28 as described above (see e.g. FIG. 7).

Torch 114 will operate in much the same manner as torches 10, 100, 110 and 112. Fuel will be supplied to torch 114 through gas tube 160 to valve 320 (see e.g. FIG. 7). An electrically energized module 20 will open valve 320 to allow fuel to flow through tube 162 and into diffuser 34 and out to the open atmosphere (see e.g. FIG. 7). Igniter/sensor 44 will provide a voltage reading to module 20 and if the voltage is below a set threshold, module 20 will send a high voltage signal to igniter 44 to create a spark across the gap created by the positioning of anode 50 and cathode 52 (see e.g. FIGS. 4C and 7). The spark will ignite the fuel and create an aesthetically pleasing flame.

The operation of torch 10 has been described above and offers many advantages over the prior art, namely, torch 10 may be a full contained and automated system. Torch 10 relies on a simple supply of fuel such as natural gas through common tubing means as well as a standard electrical system. Module 20 along with igniter/sensor 44 are fully contained within torch 10 and makes for a more aesthetically pleasing torch for landscaping purposes (i.e. there are no large unsightly computer boxes or gas supply valves that would be strewn across the landscape as required with other torch systems.) Furthermore, torch 10 does not require manual relighting. As long as the fuel supply continues to flow through torch 10 and the electrical supply remains uninterrupted, a flame will be present at the top of torch 10. Even if the flame is extinguished by wind, precipitation or other means, as long as there is fuel and electricity, torch 10 may be relit automatically and continue to produce a most aesthetically pleasing flame. Although torches 100, 110, 112 and 114 may have different aesthetic designs, they still operate in a similar manner as torch 10. There are even further designs of torch heads and poles that may be contemplated, yet will operate in a similar fashion as the invention described above.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. An automated torch comprising:

a head, said head including a burning chamber, said burning chamber being open to the atmosphere and weather elements to expose a flame to the atmosphere and weather elements;

a pole;

a valve;

a programmable computer module, said module configured to convert a low voltage to a high voltage, said module further configured to actuate said valve, said module still further configured to control said valve to vary the amount of fuel introduced into said burning chamber to modify the aesthetics of the flame;

a sleeve nut, said sleeve nut configured to be adjustable to control the amount of air introduced into said burning chamber to modify the aesthetics of the flame;

at least one fuel supply tube;

a diffuser assembly;

an igniter said igniter positioned within said burning chamber, said igniter including an anode and a cathode;

wherein said anode and said cathode are positioned such that said anode is proximate said cathode to create a sufficient gap such that when the high voltage is applied to said igniter a spark is induced across said gap;

wherein said anode and said cathode of said igniter are configured to detect the presence of a flame within said burning chamber; and wherein said igniter is configured to be electrically connected to said programmable computer module, said programmable computer module programmed to interpret a signal from said igniter to determine whether the high voltage should be induced across said gap to create the spark or whether a flame is present in said burning chamber.

2. The automated torch as described in claim 1, wherein said computer module is positioned within the interior of said head.

3. The automated torch as described in claim 1, wherein said computer module is positioned within the interior of said pole.

4. The automated torch as described in claim 1, further including a second fuel supply tube.

5. The automated torch as described in claim 4, wherein said valve is positioned between said at least one fuel supply tube and said second fuel supply tube.

6. The automated torch as described in claim 1, wherein said valve is electrically connected to said computer module.

7. The automated torch as described in claim 1, wherein said at least one fuel supply tube extends a length of the interior of said pole.

8. The automated torch as described in claim 1, wherein said diffuser assembly includes a stem and a cap and said diffuser assembly is positioned within said burning chamber.

9. The automated torch as described in claim 1, wherein said igniter is electrically connected to said computer module by a high voltage cable.

10. The automated torch as described in claim 1, wherein said anode and said cathode are configured to encircle said diffuser assembly within said burning chamber to provide for an opportunity to create a spark anywhere along said gap between said anode and said cathode and detect the presence of a flame within said burning chamber.

11. The automated torch as described in claim 1, further including electrical wiring.

12. An automated torch for generating and sustaining a flame comprising:

a head, said head including a burning chamber said burning chamber being open to the atmosphere and weather elements to expose the flame to the atmosphere and weather elements;

a pole, said pole configured to support said head;

a first fuel supply tube, said first fuel supply tube extending a length of said pole;

a second fuel supply tube;

a valve, said valve positioned between said first fuel supply tube and said second fuel supply tube to control the flow of gas through said second fuel supply tube;

a programmable computer module said module configured to convert a low voltage to a high voltage, said module further configured to actuate a valve, said module still further configured to control said valve to vary the amount of fuel introduced into said burning chamber to modify the aesthetics of the flame;

a sleeve nut, said sleeve nut configured to be adjustable to control the amount of air introduced into said burning chamber to modify the aesthetics of the flame;

a diffuser assembly, said diffuser assembly including a stem and a cap;

an igniter, said igniter being positioned in said burning chamber said igniter including an anode and a cathode;

a high voltage cable, said high voltage cable extending from said module to said igniter;

electrical wiring;

wherein said anode and said cathode are positioned such that said anode is proximate said cathode to create a sufficient gap such that when the high voltage is applied to said igniter a spark is induced across said gap;

wherein said anode and said cathode of said igniter are configured to detect the presence of a flame within said burning chamber; and wherein said programmable computer module is programmed to interpret a signal from said igniter through said high voltage cable to determine whether the high voltage should be induced across said gap to create the spark or a flame is present in said burning chamber.

13. The automated torch as described in claim 12, wherein said computer module is positioned within the interior of said head.

14. The automated torch as described in claim 12, wherein said computer module is positioned within the interior of said pole.

15. The automated torch as described in claim 12, wherein said valve is electrically connected to said computer module.

16. The automated torch as described in claim 12, wherein said diffuser assembly is positioned within said burning chamber.

17. The automated torch as described in claim 12, wherein said anode and said cathode are configured to encircle said diffuser assembly within said burning chamber to provide for an opportunity to create a spark anywhere along said gap between said anode and said cathode and detect the presence of a flame within said burning chamber.

* * * * *